United States Patent [19]

Ferrell

[11] 4,143,785

[45] Mar. 13, 1979

[54] PLASTIC VACUUM SEALING CAP

[75] Inventor: Joseph C. Ferrell, Bradenton, Fla.

[73] Assignee: Sun Coast Plastic Closures, Inc., Bradenton, Fla.

[21] Appl. No.: 887,263

[22] Filed: Mar. 16, 1978

[51] Int. Cl.[2] ..... B65D 53/00

[52] U.S. Cl. ..... 215/270; 215/344; 215/DIG. 1

[58] Field of Search ..... 215/344, DIG. 1, 329, 215/270

[56] References Cited

U.S. PATENT DOCUMENTS

| | | | |
|---|---|---|---|
| 3,180,534 | 4/1965 | Duda | 215/344 X |
| 3,232,470 | 2/1966 | Gibson | 215/344 |
| 3,339,773 | 9/1967 | Stull | 215/344 X |
| 3,463,340 | 8/1969 | Lindstrom | 215/344 X |
| 3,482,725 | 12/1969 | Exton | 215/344 X |
| 3,815,771 | 6/1974 | Marks | 215/344 |
| 3,854,618 | 12/1974 | Beghnini | 215/307 |

FOREIGN PATENT DOCUMENTS

| | | | |
|---|---|---|---|
| 667287 | 7/1964 | Italy | 215/DIG. 7 |
| 564461 | 7/1975 | Switzerland | 215/344 |

*Primary Examiner*—Donald F. Norton
*Attorney, Agent, or Firm*—Jones, Tullar & Cooper

[57] ABSTRACT

A plastic cap for vacuum sealing glass containers such as bottles or jars is disclosed. The cap includes a top wall and a depending annular side wall which extends over and is adapted to be threadedly secured to the neck of a container. The depending side wall has at its lower edge a lead-in chamfer and suitable threads adapted to engage corresponding threads formed on the exterior of the container to which it is to be secured. In a preferred form, serrations are provided on the exterior surface of the cap for gripping purposes, and a reinforcement shoulder is located on the outer perimeter of the side wall adjacent the lower edge thereof to prevent excessive cap expansion upon application to a container. Vacuum sealing is attained by means of two annular flanges depending from and integrally formed with the top wall of the cap. The two flanges are so located and angled as to engage the inner and outer rim edges of the container to which the cap is applied, whereby the flanges form air-tight seals with the rim edges when the cap is screwed onto the container.

4 Claims, 6 Drawing Figures

FIG. 1
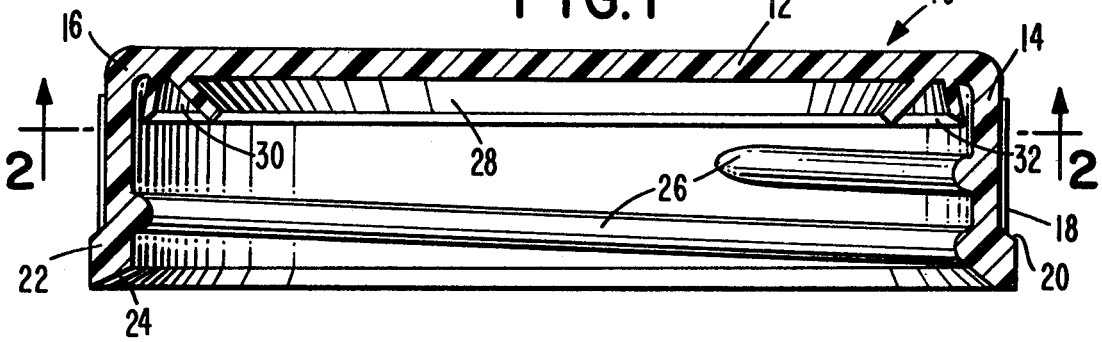
FIG. 2
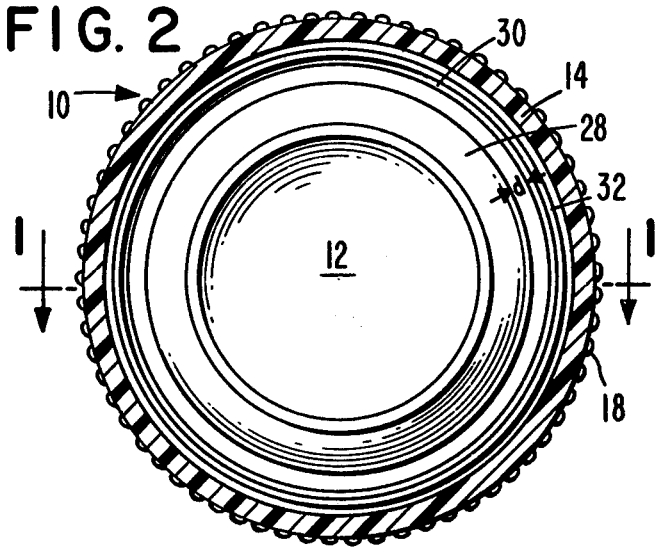
FIG. 3
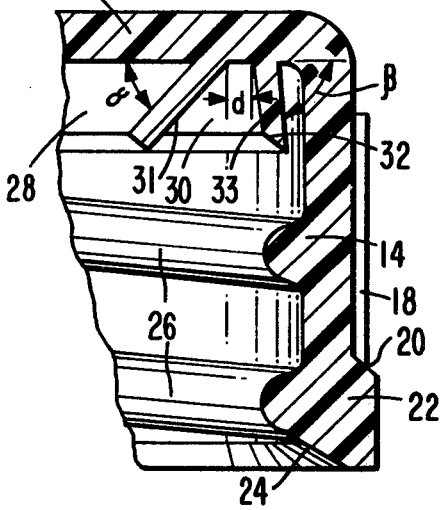
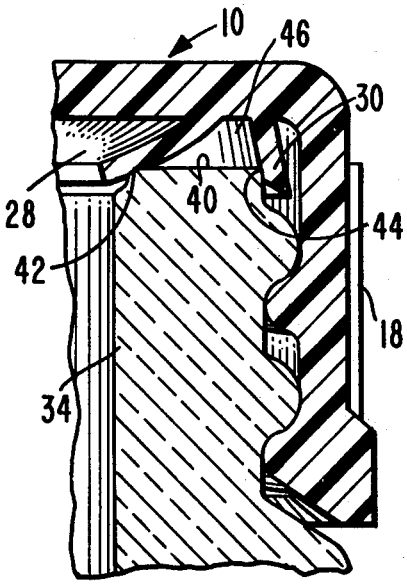
FIG. 4
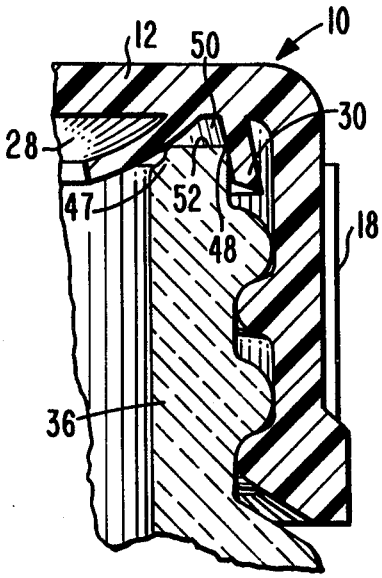
FIG. 5
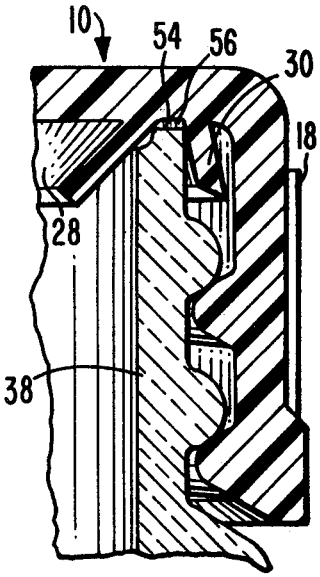
FIG. 6

PLASTIC VACUUM SEALING CAP

BACKGROUND OF THE INVENTION

The present invention relates, in general, to plastic caps for containers, and more particularly to plastic vacuum sealing caps.

Particularly in food packing applications, but in other application as well where material in a container is subject to spoilage or degeneration in the presence of air, it is the practice in many cases to produce a relatively strong vacuum within the container for such material and to seal the container by means of a suitable closure such as a cap or cover to prevent air from entering the container. To obtain and to maintain a suitable vacuum over a period of time sufficient to give reasonable shelf life to the contents of the container, it is necessary to provide a secure and reliable sealing of the cover-to-container interface. In the past, a wide variety of cover designs and configurations have been provided for containers, with many being in the form of metal caps. However, for economic reasons and because there have been some indications that metal caps may adversely affect some foods, there has been an effort to develop an effective plastic cap for vacuum sealing containers, and in particular for sealing glass bottles and jars.

Over the years, many attempts have been made to develop satisfactory plastic caps for this purpose, but numerous problems have been encountered. For example, it has been found that many plastics deteriorate over a period of time, causing cracking and breaking of the cap and resulting in a poor shelf life for the packaged product. Even if the material did not crack or break, it would often gradually deform over a period of time allowing leakage around the edges of the cap and consequent spoilage of the contents. The problems of deterioration and deformation are being overcome to a large extent by the development of new plastic materials, and interest in such caps has been renewed, for it has long been known that there is a real economic advantage in plastic caps because of the ability to produce them in high quantities at reasonable cost.

Any immediate change to plastic caps has, however, been seriously impeded by the fact that heretofore there has not been a suitable structural design for a cap that would enable a manufacturer to take advantage of the apparent superiority of this material. The difficulty was that in all of the prior designs, a very exact fit between the container edge and the cap was required if the cap was to produce an effective seal, but the manufacturer was faced, in the typical manufacturing environment, with the problem of variations in the wall thickness of glass bottles and jars. With conventional molding techniques for the production of glass containers, wide variations occur in the thickness of the neck wall, even between containers made from the same mold. With prior plastic cap designs, the inside of the bottle or jar neck wall had to be precisely molded to insure that there were substantially no variations from bottle to bottle in order to create a proper seal between the bottle and the cap intended for it. In addition to the problem of variations in wall thickness from bottle to bottle, numerous irregularities occur along the mouth edges of such containers, either as a result of the molding process or because of chipping of the glass in handling the container, the latter problem being particularly serious when glass containers are returned for reuse. To eliminate such variations in the container to accommodate plastic caps would have required changes in glass molding techniques that would have greatly increased the costs of such containers, and would have put an end to recycling used containers.

PRIOR ART

Examples of prior art patents disclosing plastic cap designs and structures are: U.S. Pat. No. 3,463,340 to Lindstrom, U.S. Pat. No. 3,854,618 to Beghnini, and U.S. Pat. No. 3,583,591 to Hayashida.

BRIEF SUMMARY OF THE INVENTION

It is an object of the present invention to provide a plastic bottle cap that overcomes the problems of the prior art and which will permit a secure, reliable vacuum seal for glass containers such as bottles and jars.

More particularly, it is an object of the present invention to provide a bottle or jar cap which will retain a vacuum seal on containers of varying wall thickness and having irregularities, such as chips and the like, around the rim thereof, whereby the requirements for precision molding of caps and containers are eliminated.

Briefly, the present invention meets the foregoing objects and overcomes the problems encountered in the prior art through the provision of a plastic vacuum sealing cap which incorporates a top wall and a depending annular side wall which are adapted to cover and encompass the mouth of a glass container such as a bottle or jar. The side wall carries suitable threads for engagement with corresponding threads on the outer surface of the glass container, with the bottom edge of the side wall being chamferred to facilitate placement of the cap on the container. The exterior surface of the side wall carries a reinforcement shoulder around its bottom perimeter to prevent excessive cap expansion and preferably is serrated to improve gripping.

The principal feature of the cap is the provision of two flexible, annular vacuum sealing flanges, or lips, depending from, and formed integrally with, the top wall of the cap. The annular flanges are adapted to engage the inner and outer edges of the upper rim of the glass container to provide a vacuum seal when the cap is threaded firmly into place. The two flanges are concentric, with the outer flange being canted outwardly toward the side wall of the cap in order to insure that it contacts substantially only the outer rim edge of the glass container. In a preferred form of the invention, the outer rim is canted 10° away from the axis of the cap, which is perpendicular to the top wall. This angled arrangement differs from many of the prior art arrangements in that the outer flange does not depend upon a surface contact with the outer surface of the container in order to obtain the desired sealing action and thus does not have to be precisely aligned with or conformed to the shape of the outer surface. By canting the outer flange outwardly, the flange only has a line contact with the rim edge, making a sealing contact much simpler to attain when there are irregularities in the glass container.

The second annular flange is spaced inwardly from the first flange toward the axis of the cap, and thus is of smaller diameter, and is adapted to contact the inner rim edge of the container to which the cap is applied. To accommodate containers of varying thicknesses, the inner flange extends at an angle of approximately 45° with the top wall of the cap. This angle insures a substantially line contact with the inner rim edge of the container, and produces sufficient flexibility in the flange to insure a continuous contact even though there may be irregularities in the wall thickness or in the inner rim edge.

In use, the cap is applied to a suitable glass container in the usual fashion in a vacuum environment, and the cap is tightened down so that the inner and outer depending flanges engage the inner and outer rim edges of the wall of the container, respectively. As the cap is tightened down, the outer flange is deflected slightly outwardly toward the side wall of the cap, but not in contact therewith, to provide a continuous line seal with the outer rim edge of the container to serve as the vacuum seal when the container is removed from the vacuum environment. At the same time, the inner rim edge of the container mouth deflects the inner flange inwardly to provide a tight mechanical seal, with the space between the two flanges and over the rim of the container defining a closed annular pocket around the top surface of the container.

When the closed container is removed from the vacuum environment, atmospheric pressure will tend to press the cap more firmly onto the container to insure maintenance of the vacuum within. This atmospheric pressure on the top of the cap will tend to press the inner flange downwardly against the inner rim of the container, while the vacuum in the pocket formed between the two flanges will tend to pull the outer flange more tightly against the outer rim, so that the atmospheric pressure thus exerted on the exterior of the cap tends to improve the sealing operation of the two flanges. The pocket formed between the two flanges acts as a suction cup so that it contains a vacuum which is intermediate that within the container and the pressure of atmosphere, to hold the flanges against the container rim edges.

If the cap is removed from the container to release the vacuum, it may be replaced to reseal the container, for the two depending flanges produce good mechanical seals on the container rim edges when the cap is screwed onto the container. Thus, the cap functions as a resealable closure for the container.

BRIEF DESCRIPTION OF THE DRAWINGS

The foregoing and additional objects, features and advantages of the present invention will become apparent to those of skill in the art from a consideration of the following detailed description of a preferred embodiment thereof, taken in conjunction with the accompanying drawings, in which:

FIG. 1 is a cross-sectional view, taken along line 1—1 of FIG. 2, of a vacuum sealing cap constructed in accordance with the present invention;

FIG. 2 is a bottom sectional view, taken along line 2—2 of FIG. 1, of the cap of the present invention;

FIG. 3 is a partial sectional view of the cap of FIG. 1, illustrating the construction of the sealing flanges;

FIG. 4 is a partial sectional view of the cap of the present invention as applied to a glass container having a relatively thick wall;

FIG. 5 is a partial sectional view of the cap of the present invention as applied to a glass container having a side wall of moderate thickness; and FIG. 6 is a partial sectional view of a cap in accordance with the present invention as applied to a glass container having a relatively thin side wall.

DESCRIPTION OF THE PREFERRED EMBODIMENT

Turning now to a more detailed consideration of the invention, there is illustrated at 10 in FIGS. 1 and 2 a plastic cap made in accordance with the present invention and adapted to engage and close the mouth of a glass container such as a bottle or jar and to provide a vacuum sealing closure therefor, and after the container has been opened and the seal broken, to provide a resealable closure. Preferably, the cap is injection molded or otherwise formed from a suitable plastic material such as polystyrene, polyethylene, or the like, although the material from which the cap is constructed may be any plastic material which can withstand the stresses imposed in the use of the cap and which can provide the desired shelf life for such caps. Such materials are conventional and are known in this art.

Cap 10 includes a top wall 12 having a diameter which is determined by the outside diameter of the container which it is to enclose, and having a thickness proportional to its diameter, the thickness depending, in part, upon the degree of vacuum to be sealed and the shelf life desired of the cap. It has been found that a wall thickness of approximately 1/16 inch (1.588 mm) will meet the needs of most applications, although it will be apparent that the exact thickness required depends upon the size of the container, the degree of vacuum within the container, the particular materials used, as well as the particular method used in manufacturing the cap. The cap includes an annular side wall 14 which is substantially perpendicular to, is integrally formed with, and depends from, the top wall 12, joining the top wall at the corner 16. The exterior surface of the side wall is provided with serrations 18 which extend outwardly from the side wall to provide a gripping surface.

The lower edge of side wall 14 flares outwardly at 20 to form a reinforcement shoulder 22 which extends around the lower perimeter of the side wall providing an added thickness which prevents excessive expansion upon application of the cap to a container. The lower edge is also formed with a lead-in chamfer 24 which facilitates placement of the cap on a container and which provides a lead-in to thread 26 formed on the inner surface of side wall 14. These threads are adapted to engage corresponding threads on a container wall for securing the cap to the neck portion of the container.

The cap incorporates a pair of depending, annular, sealing flanges 28 and 30 which are integral with the cap. These two flanges are concentric with each other (see FIG. 2) and with the annular side wall, and are coaxial with the axis of the cap, which is at the center of, and is perpendicular to top wall 12. The innermost flange 28 is canted inwardly toward the axis of the cap, and has the smallest diameter, the outer flange 30 is spaced outwardly from flange 28, is canted outwardly away from the axis, and has an intermediate diameter, and the annular wall 14 is spaced outwardly from flange 30 and has the largest diameter. The particular spacing and angular relationship of the two flanges with respect to each other and the cap top and side wall are critical to the function of the cap in ensuring a proper sealing operation for a variety of glass container wall thicknesses. Since the two cap sealing flanges work independently, a proper sealing of the container will be maintained even in the presence of a chipped inner or outer wall edge.

As may be seen most clearly in FIG. 3, the innermost flange 28 extends downwardly from its base where it joins the top wall 12 and is angled inwardly toward the central axis of the cap, the flange forming an angle $\alpha$ with respect to the plane of the top wall 12 of the cap. In the preferred embodiment of the invention, this angle is equal to approximately 45° to provide maximum exposure of its lower surface 31 to contact with a container consonant with the need for sufficient resistance to bending forces when the cap is applied to a container to insure a good mechanical seal. In a cap for a small-mouthed container such as a conventional soda bottle having a wall thickness of about ⅛ to ¼ inch, flange 28 preferably will be approximately ¼ inch long. The flange should be sufficiently thick to ensure a good mechanical seal, yet thin enough to be resilient so that it will conform to irregularities in the container. The exact thickness will depend on numerous factors, such as the material used, the diameter of the cap, the length of the flange, and the like, but in a typical application may be on the order of 1/32 inch.

The base of outer flange 30 is spaced outwardly from the base of flange 28, where the bases join the top wall 12, by a distance "d", as illustrated in FIG. 3. Because of the angular relationship of the inner and outer flanges, this distance is not critical, but may vary in accordance with the nominal wall thickness of the bottles or jars which are to be sealed. This distance "d" should be less than the minimum wall thickness of the container to which the cap is to be applied so that the inner and outer edges of its rim will contact the flanges 28 and 30, respectively.

The outer flange 30 extends downwardly from its base, where it joins the top wall 12, and is angled outwardly, away from the axis of the cap, the flange forming an angle "$\beta$" with the plane of the top wall 12, as illustrated in FIG. 3. The bottom edge of the flange is provided with a lead-in chamfer 32 to ensure that the top rim of a container is guided into the interior of flange 30 as the cap is applied thereto, and the angle $\beta$ is selected so that the interior surface 33 of flange 30 will contact the outer rim edge of the container. It has been found that this angle should be approximately 80°, which is sufficient to ensure the desired edge contact while providing the firm contact required for a good vacuum seal. Outer flange 30 is spaced inwardly from the wall 14 of the cap by a distance sufficient to ensure that when the cap is applied to a container, the rim thereof will not force the flange outwardly into engagement with the side wall 14. By leaving the flange spaced sufficiently far to be free of the side wall, the flange can flex outwardly as the cap is threaded onto the bottle and conform itself to the outer rim edge of the bottle, thereby providing a proper vacuum seal. On the other hand, the flange 30 must be located far enough out toward the side wall to ensure that the outer surface of the container will engage the inner surface 33 rather than the bottom edge 32 of the flange as the cap is threaded onto the container.

FIGS. 4, 5 and 6 illustrate the application of cap 10 to the necks of various glass containers 34, 36 and 38, respectively, each having exterior threads adapted to receive the threaded portion 26 of the cap. As illustrated, container 34 has a relatively thick wall, container 36 has a wall of intermediate thickness, while container 38 illustrates a bottle having a neck portion utilizing a relatively thin wall structure. Referring to FIG. 4, it will be seen that the container has a mouth or top opening defined by a circumferential top rim 40 which fits into the space between the inner and outer flanges 28 and 30 when the cap is threaded thereon. The inner rim edge 42 of the container engages the surface 31 of flange 28 while the outer rim edge 44 of the container engages the surface 33 of outer flange 30. By threading the cap onto the container, the inner edge 42 mechanically deforms flange 28, forcing it inwardly and upwardly toward the top wall 12 of the cap, with the mechanical force required to apply the cap serving to provide a firm mechanical seal to the bottle. At the same time, the outer rim edge 44 mechanically engages flange 30, deforming it slightly outwardly to again produce a firm mechanical seal.

This mechanical engagement of the two flanges 28 and 30 with the rim edges 42 and 44, respectively, forces the two flanges against the container in such a way as to ensure a good seal, while at the same time forming a pocket 46 above the rim of the container and between the two flanges. If the cap is pressed downwardly as it is threaded onto the bottle, and then released after the two flanges have firmly engaged the inner and outer rim edges of the container, the release of the cap will produce a "suction cup" effect in pocket 46 which tends to hold the cap on the container to provide an improved seal therewith. This mechanical sealing arrangement and the "suction cup" effect caused by pocket 46 enables the cap to be used to reseal a container. On the other hand, the mechanical pressure applied to the flanges when the cap is threaded onto a container which is to be vacuum sealed not only produces the above-described mechanical seal, but removal of the container from a vacuum chamber after such sealing causes atmospheric pressure to press downwardly on the top wall of the cap toward the interior of the container to thereby improve the mechanical seal provided by the interior flange 28. Further, the atmospheric pressure produces an inward force on flap 30, thereby improving its sealing contact with the outer rim 44.

Thus, the two flanges cooperate with each other and with the rim of the container, when the cap is rotated onto the threaded mouth of the container to its prescribed degree of tightness, to provide a highly reliable and long-lasting seal for the container. The mechanical pressure created by tightening the cap combined with the vacuum within the container result in inner and outer seals which, although they have essentially independent origins, cooperate in a unique and unexpected manner to produce a highly effective seal for vacuum containers, as well as a unique and effective resealing cap for such containers to provide improved protection for the contents of the container. This occurs because the dual sealing effect of the mechanical torque applied to the cap and the vacuum applied to the interior of the container cooperate in a unique way to ensure that the integrity of seal will be maintained even in the presence of cracks, chips or the like on either of the rim edges 42 or 44, and ensures that the two flanges will conform to the rim edges even if there should be variations in the thickness of the wall of the container around its perimeter. Cracked and chipped edges are common where glass containers are recycled, and variations in the wall thickness around the perimeter thereof is a common problem in the manufacturing process for such containers. Since the double flange arrangement of the cap 10 assures a proper seal even in the presence of such anomalies in the container wall, it is a distinct improvement over prior art arrangements and structures.

When a bottle or jar having a wall with an intermediate nominal thickness, such as that illustrated in FIG. 5, is covered by cap 10, the inner and outer rim edges 47 and 48 of the container 36 engage the inner and outer flanges 28 and 30, respectively, in the manner described with respect to FIG. 4. As illustrated, the thinner wall causes the cap to thread further onto the container and the rim edges to contact the flanges at points closer to the top wall 12 than was the case in the FIG. 4 illustration. However, the flanges still form a pocket 50 above the container rim 52 and still contact only the rim edges of the container to provide the desired sealing arrangement.

As illustrated in FIG. 6, when the container wall 38 is very thin, the upper rim 54 will engage the flanges 28 and 30 at a location quite near the top wall 12. However, as long as the thickness of the container wall is greater than the distance "d" between the two flanges, the seal will not be adversely affected, for the inner and outer rim edges will still engage the flanges 28 and 30 and will form a pocket 56 above the rim of the container in the manner previously described. Although the inner and outer flanges may not be flexed or distorted in as obvious a manner as would be the case with thicker walled jars or bottles, nevertheless the cap may be screwed down tight enough to produce the requisite mechanical forces on the flanges to ensure maintenance of the desired seal.

Because of the flexibility and resilience of the relatively thin flanges, and because of their angled relationship to the top wall 12 of the cap, the flanges engage the inner and outer rim edges only of the container to which the cap is applied, and do not rely upon an extended surface contact for obtaining a vacuum seal, thus eliminating the need for precisely formed bottles such as were required for previously known sealing caps. The resultant wider tolerance range for bottles and jars permits a longer life for the dies and molds used in the manufacture of such containers, and thus reduces the overall cost of manufacture. Thus there has been disclosed a new and improved cap for bottles, jars, and other glass containers which overcomes the disadvantages of prior art devices, and which provides a reliable and more economical seal for such containers. The cap may be easily manufactured, as by injection molding techniques, and ensures a reliable seal for bottles of various thicknesses and having anomalies such as variations in the wall thickness and cracks and chips along the rim edges thereof. Although the invention has been disclosed in terms of a specific embodiment, it will be appreciated that numerous modifications and variations may be made by those of skill in the art without departing from the true spirit and scope thereof as set forth in the following claims.

What is claimed is:

1. A resealable plastic cap for vacuum sealing of containers, comprising:

a top wall to extend over and to cover the mouth of a container to which the cap is to be applied;

an annular side wall integrally formed with and depending from the perimeter of said top wall;

a first annular flange integral with and depending from said top wall, said first flange having substantially parallel inner and outer surfaces and being angled downwardly toward the axis of said cap to form an angle of substantially 45° with the plane of said top wall, said first flange being of sufficient length and extending sufficiently far below the plane of said top wall that the outer surface thereof will engage the inner rim edge of a container wall, the angle of said first flange providing a linear contact with the rim edge;

a second annular flange integral with and depending from said top wall, said second flange being independent of, concentric with and spaced outwardly from said first flange and being concentric with and spaced inwardly from said annular side wall by a distance sufficient to prevent contact with said side wall when said cap has been applied to a container, said second flange further having substantially parallel inner and outer surfaces, being angled downwardly away from the axis of said cap and forming an angle of substantially 80° with the plane of said top wall, and being of sufficient length and extending sufficiently far below the plane of said top wall that the inner surface of said second flange will engage the outer rim edge of a container wall, the angle of said second flange providing a linear contact with the rim edge;

said first and second flanges each having a base portion at its intersection with said top wall, the bases of said first and second flanges being spaced apart a distance sufficient to insure flange contact with the inner and outer rim edges only of the container to which the cap is to be applied, the distance between the bases being less than the wall thickness of such a container; and said first and second flanges being sufficiently flexible to permit the flanges to conform to variations in, and to provide continuous sealing contact with, the peripheral inner and outer rim edges of containers and being so spaced and angled with respect to each other and a container wall as to define a pocket when said cap is applied to a container, said flanges cooperating with the rim edges of the container wall to provide a vacuum seal for containers having varying wall thicknesses, saddle defects, chips and other anomolies, and further cooperating to produce a suction effect in the pocket to permit use of the cap to reseal such containers.

2. The cap of claim 1, further including thread means on the interior surface of said side wall to cooperate with threads on the exterior surface of the neck of a container.

3. The cap of claim 1, further including a chamfer on the lower edge of said second flange, said chamfer tapering downwardly toward the outer surface of said second flange to serve as a guide to insure contact between the inner surface of said second flange and the outer rim edge of a container to which said cap is applied.

4. The cap of claim 1, wherein said first and second flanges extend equal distances below the plane of said top wall.

* * * * *